US005492320A

United States Patent [19]

Hoffman et al.

[11] Patent Number: 5,492,320

[45] Date of Patent: Feb. 20, 1996

[54] BEAN BAG WITH RIGID CENTRAL MEMBER

[76] Inventors: Christopher Hoffman, 404 Massoit, Clawson, Mich. 48017; Lawrence Hofmann, 29235 Westbrook Pkwy., Southfield, Mich. 48076

[21] Appl. No.: 425,999

[22] Filed: Apr. 20, 1995

[51] Int. Cl.[6] ..... A63B 65/00

[52] U.S. Cl. ..... 273/415

[58] Field of Search ..... 273/415, 424, 273/425

[56] References Cited

U.S. PATENT DOCUMENTS

| | | | |
|---|---|---|---|
| 715,249 | 12/1902 | Dunbar | 273/415 X |
| 4,943,065 | 7/1990 | DeLapa | 273/415 X |
| 4,943,066 | 7/1990 | Lathim et al. | 273/415 |
| 5,067,727 | 11/1991 | Crompton | 273/336 |
| 5,324,042 | 6/1994 | Demas | 273/415 X |

*Primary Examiner*—Paul E. Shapiro

*Attorney, Agent, or Firm*—Gifford, Krass, Groh, Sprinkle, Patmore, Anderson & Citkowski

[57] ABSTRACT

A bean bag projectile comprises a disc shaped bag having a rigid connector member joining central portions of the two circular faces thereof. The connector configures the interior volume of the bean bag as a toroidal space, and the space is filled with a granular material. The bag retains its shape when struck by a like bag and is particularly suited for playing a toss shuffle board game which the bags slide and knock one another across a smooth playing surface.

10 Claims, 1 Drawing Sheet

BEAN BAG WITH RIGID CENTRAL MEMBER

FIELD OF THE INVENTION

This invention relates generally to bean bags for use as aerial game projectiles and more specifically to a bean bag of a disc shaped configuration, including rigid central portion which restricts the filler material to a toroidal interior volume and which causes the bean bag to retain its disc shape in play.

BACKGROUND OF THE INVENTION

Conventional bean bags are flexible bags filled with loose granular material and are commonly used in target type games. They are tossed for the purpose of knocking over objects, turning a mechanical apparatus to a new position, or entering into scoring holes on a playing board. Shuffle board is a game in which rigid metal, fiber composite or polymeric discs are slid across a playing surface toward a target region. In the course of the play, the players strive to slide their disc so as to knock other discs into, or out of, the target area. The present invention is directed to a toss shuffle board game in which players toss appropriately configured bean bags through the air so as to cause them to land on, and slide across a playing surface in a manner similar to conventional shuffle board. Heretofore employed bean bags are not suitable for use in the aerial shuffle board game contemplated herein, since such bags deform when they strike the playing surface, or one another, thereby preventing the bumping, knocking or ricocheting action which is an integral part of the conventional game of shuffle board. Accordingly, it will be appreciated that there is a need for a bean bag projectile which can provide a realistic play action in a shuffleboard game.

U.S. Pat. No. 5,067,727 discloses a ring toss game which includes playing pieces which comprise ring shaped flexible covers filled with a particulate material and having a large central opening defined therein. The combination of the central opening, and flexible fabric causes these particular playing pieces to collapse when they strike one another. Therefore, the ring shaped bean bags of the U.S. Pat. No. 5,067,727 are not suitable for use as toss shuffle board playing pieces.

According to the present invention, there is provided a bean bag construction which includes a disc shaped bag having a volume of particulate material therein and further including a rigid central member which serves to restrict the particulate material to a toroidal, peripheral portion of the disc and which confers sufficient rigidity to the bean bag to permit realistic bumping and knocking action in the play of toss shuffle board. The particulate filled portion of the bean bag provides for a soft landing and a smooth sliding action and also enhances the safety aspects of the game. These and other advantages of the present invention will be apparent from the drawings, discussion and description which follow.

SUMMARY OF THE INVENTION

Disclosed herein is a bean bag shuffle board game projectile which comprises a first and a second flexible member fabricated from a body of sheet material, each having a generally circular perimeter. The flexible members are disposed in a superposed relationship and joined together along their perimeter so as to form a disc shaped bag which defines an interior volume. The bean bag further includes a body of granular material disposed in the interior volume, and a rigid connector disposed so as to join a central portion of each of the flexible members together. The rigid connector configures the interior volume as a torous and confines the granular material thereto. The rigid connector member is further operative to permit the bean bag to retain its disc shape when struck by a like bean bag.

The bag may be fabricated from cloth, leather, polymeric material or combinations thereof. The granular filler may comprise seeds such as beans, peas or rice, or a material such as plastic pellets, metallic pellets, sand, gravel, ground nut shells and various combinations thereof. The connector may comprise a button, grommet, snap or the like. The bag typically has a diameter in the range of 2–12 inches, and most preferably 3–6 inches, and the rigid connector is a circular member typically having a diameter in the range of 0.5–4 inches and more typically 0.5–2 inches.

Figure 1:
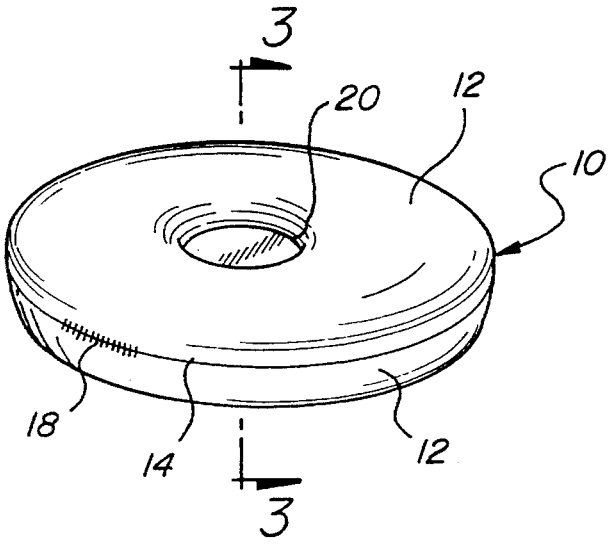
FIG. 1 is a perspective view of a new bean bag aerial game projectile constructed in accordance with the invention.
Figure 2:
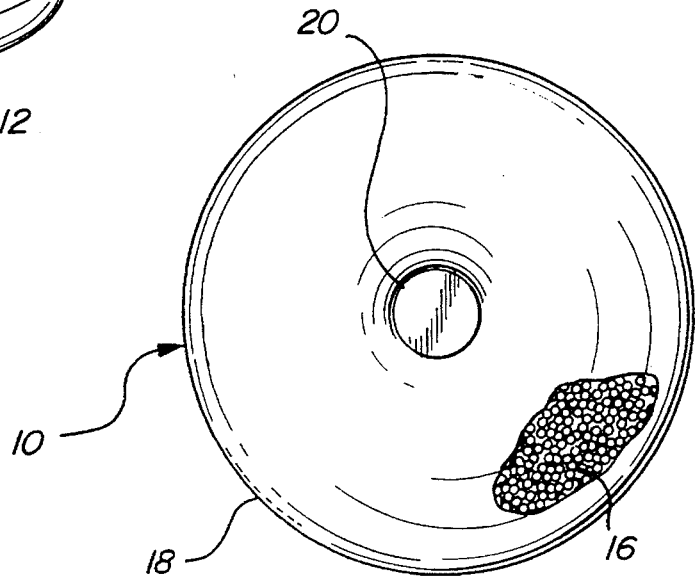
FIG. 2 is a top plan view of the bean bag with a portion of the bag removed to show the interior thereof.

| Reference Numerals in Drawings | |
|---|---|
| 10 bean bag | 18 outside filler seam |
| 12 flexible material | 20 connector |
| 14 inside seam | 22 male side of closure |
| 16 pellets | 24 female side of closure |

DETAILED DESCRIPTION OF THE PREFERRED EMBODIMENT

It will be understood that the term "bean bag" as used herein refers to the generic meaning of the term, namely any similar structure having a flexible cover and filled substantially with loose granular material.

Figure 3:
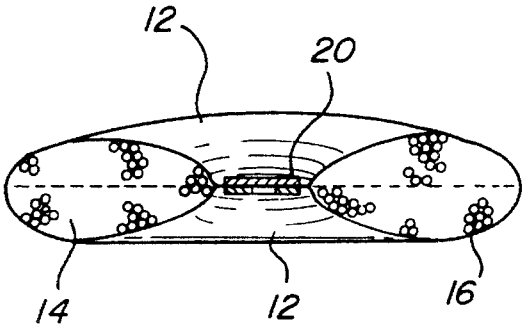
FIG. 3 is a sectional view taken along the line 3—3 of FIG. 1.

Referring to FIGS. 1–4, the preferred embodiment of the invention is shown. The bag 10 is constructed of two flexible round pieces of tightly woven cloth 12 with a diameter of approximately 5 inches. Preferably, double stitching with heavy duty nylon thread is used to join the two identical panels of cloth 12, creating a circle that has an inside diameter of approximately 4.5 inches, but leaving approximately 0.25 of an inch of the circumference not sewn. This stitching is called the inside seam 14 as shown in FIGS. 1 and 3.

The bag 10 is then turned inside out and filled with approximately 75 grams of pellets 16 through the opening at the yet completed outside filler seam 18. The preferred pellets 16 are a high density polyethylene, water cooled pellet.

To form the finished outside filler seam 18, the excess material of the two pieces 12 at the outside filler seam 18 is tucked inwardly until the material completes the circle created by the inside seam 14. This material is sewn, preferably with a double stitch and heavy duty nylon thread, thus completing the outside filler seam 18.

Figure 4:
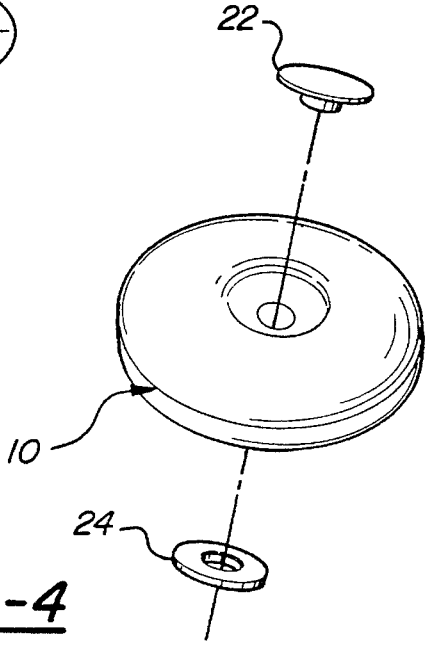
FIG. 4 is an exploded view of one embodiment of the connector as applied to a bean bag.

The rigid connector 20, in one preferred embodiment, is a button consisting of a male side 22, and a female side 24 which are press fit together as shown in FIG. 4. The button 20 is approximately 0.625 of an inch in diameter made of brass, steel or other non-corrosive, rigid material. The button 20 is affixed at the center of the bean bag. In other embodiments, the rigid connector may comprise a snap or a grommet, or a sewn-in button. It is important that the connector be rigid so as to cause the bean bag to retain its shape when struck in play. In the context of the present disclosure, a rigid connector is defined as a member which joins the two surfaces of the bean bag so as to exclude filler from a central region, and which will not significantly deform under conditions normally encountered in the play of bean bag based games. The rigid connectors will typically be fabricated from materials such as metal, wood and non-elastomeric polymers; although in some instances, hard rubber and other such very slightly elastomeric materials may be employed.

Accordingly, the reader will see that the addition of a rigid, centrally located member on a bean bag game projectile creates a new structure with new capabilities. The central member restricts the flow of pellets within the bean bag. This results in a disc-like bean bag that will retain its relative shape and is capable of bumping one or more like bean bags on a playing surface and transferring kinetic energy thereto. The central member, in its preferred embodiment, also reduces the surface friction by compressing the center of the bean bag. Thus, the center of the bean bag is lifted off a playing surface, allowing the bean bags to slide and bump farther. This soft disc-like aerial projectile results in a game piece that can be safely used indoors or outdoors. Typically, the bean bag will be circular although it has been found that bags having 5 or more sides will usually perform well in most game applications; hence, within the scope of the present application, such bags will be referred to as being "generally circular". In most instances, the bags of the present invention will be in the range of 2–12 inches in diameter, and more preferably 3–6 inches in diameter; most preferably, the bags are 4.5 inches in diameter. In general, it has been found that the bag should be filled to at least 50% of its capacity and more preferably, to approximately 60% of its capacity, as measured prior to the insertion of the rigid member. After the rigid member is inserted, the filled percentage will be somewhat higher.

In our preferred embodiment, the use of an inside seam creates a relatively blunt outer edge. The result is more surface area on the outer edge of the bean bag. This helps like bean bags to bump one another more consistently and predictably; and also helps to prohibit the stacking of bean bags during the normal course of sliding and bumping in game situations.

While our above description contains many specific details these should not be construed as limitations on the scope of the invention, but rather as an exemplification of one preferred embodiment thereof. Many other variations are possible. For example, the rigid connector may comprise a disc of solid material affixed to the bag so as to fill a portion of its interior volume. The bag itself can be made of any flexible material such as plastic, vinyl or leather, or can be made of cloth such as cotton, rayon, polyester and the like. The bag may also be made of a blend of materials. The bag material may be configured with surface bumps or indentations to modify play action. The bag may also include raised stitching, pellets or other such material affixed to the surface thereof. It will be appreciated that the size of the bag may be varied from that shown herein, and the bag may be polygonal rather than round; although as noted above, it generally should include at least five sides in order to achieve proper play. Although the bag is shown as fabricated from two generally circular pieces of cloth, it may be fabricated from a larger number of cloth segments joined together. The bag may be assembled by stitching which may be on the exterior or interior thereof, or it may be assembled by gluing, heat sealing or ultrasonic welding. The amount of filler material maybe varied as appropriate, although relatively tight fill should be maintained so as to provide proper bumping action. Over filling should be avoided to prevent erratic bouncing of the bag.

The filler material may comprise beans, peas, rice or other such seeds. Alternatively, it may comprise crushed nut shells, sawdust or other such industrial waste as well as plastic or metal pellets.

In view of the foregoing, it is to be understood that the drawings, discussion and description presented herein are illustrative of particular embodiments of the present invention and are not limitations upon the practice thereof. It is the following claims, including all equivalents, which define the scope of the invention.

We claim:

1. A bean bag game projectile comprising:

a first and a second flexible member, each comprising a body of sheet material having a generally circular perimeter, said members being disposed in a superposed relationship and joined together along the perimeters thereof so as to form a disc shaped bag defining an interior volume;

a body of granular material disposed in said interior volume; and a rigid connector disposed so as to join a central portion of each of said flexible members together so as to configure said interior volume as a torus and to confine the granular material thereto, said rigid connector being further operative to cause said bean bag to retain its disc shape when struck by a like bean bag.

2. A projectile as in claim 1, wherein said flexible members are fabricated from a material selected from the group consisting of: cloth, leather, polymeric material, and combinations thereof.

3. A projectile as in claim 1, wherein said body of granular material is selected from the group consisting of: beans, peas, rice, pellets of a polymeric material, pellets of a metallic material, gravel, sand, sawdust, ground nut shells, and combinations thereof.

4. A projectile as in claim 1, wherein said rigid connector comprises a member selected from the group consisting of: buttons, grommets, snaps, and combinations thereof.

5. A projectile as in claim 1, wherein said projectile has a diameter of approximately 2–12 inches.

6. A projectile as in claim 5, wherein said projectile has a diameter in the range of 3–6 inches.

7. A projectile as in claim 6, wherein said projectile has a diameter of approximately 4.5 inches.

8. A projectile as in claim 1, wherein said rigid connector is a circular member having a diameter in the range of 0.5–4 inches.

9. A projectile as in claim 1, wherein said rigid connector is a circular member having a diameter in the range of 0.5–2 inches.

10. A bean bag shuffle board projectile comprising:

a flexible, disc shaped bag defining an interior volume;

a body of granular material disposed in said interior volume; and a rigid connector disposed so as to join two portions of said disc shaped bag together so as to configure said interior volume as a torus and to confine the granular material thereto, said rigid connector being further operative to cause said bean bag to retain its disc shape when struck by a like bean bag.

* * * * *